US010515740B2

(12) United States Patent
Yang et al.

(10) Patent No.: US 10,515,740 B2
(45) Date of Patent: Dec. 24, 2019

(54) FLAME-RETARDANT FLAT ELECTRICAL CABLE

(71) Applicant: 3M INNOVATIVE PROPERTIES COMPANY, St. Paul, MN (US)

(72) Inventors: Rui Yang, Austin, TX (US); Ta-Hua Yu, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/025,135

(22) Filed: Jul. 2, 2018

(65) Prior Publication Data

US 2019/0019600 A1 Jan. 17, 2019

Related U.S. Application Data

(60) Provisional application No. 62/530,912, filed on Jul. 11, 2017.

(51) Int. Cl.

| | |
|---|---|
| ***H01B 7/02*** | (2006.01) |
| ***H01B 7/295*** | (2006.01) |
| ***H01B 3/10*** | (2006.01) |
| ***H01B 7/08*** | (2006.01) |

(52) U.S. Cl.

CPC ..... *H01B 7/295* (2013.01); *H01B 3/10* (2013.01); *H01B 7/0225* (2013.01); *H01B 7/0241* (2013.01); *H01B 7/0258* (2013.01); *H01B 7/0861* (2013.01)

(58) Field of Classification Search

CPC .... H01B 7/295; H01B 7/0225; H01B 7/0241; H01B 7/0258; H01B 7/0861; H01B 3/10

USPC ..... 174/110 R, 112, 113 R, 115, 117 R, 174/117 F, 117 FF

See application file for complete search history.

(56) References Cited

U.S. PATENT DOCUMENTS

| | | | | |
|---|---|---|---|---|
| 3,425,004 | A * | 1/1969 | Warner | F42B 3/188 333/184 |
| 5,828,007 | A * | 10/1998 | Fujishita | H01B 7/428 174/120 R |
| 9,136,042 | B2 * | 9/2015 | Sugiyama | H01B 11/00 |
| 2002/0195266 | A1 * | 12/2002 | Yosomiya | H01B 7/0838 174/117 F |
| 2006/0083948 | A1 * | 4/2006 | Kawaguchi | H01F 10/08 428/692.1 |
| 2009/0130356 | A1 * | 5/2009 | Moriuchi | C08L 23/02 428/36.9 |
| 2009/0255707 | A1 * | 10/2009 | Moriuchi | C08L 31/04 174/110 SR |
| 2011/0236662 | A1 * | 9/2011 | Fukuda | B32B 27/08 428/216 |
| 2012/0205136 | A1 * | 8/2012 | Moriuchi | C08G 79/02 174/110 SR |
| 2012/0267159 | A1 * | 10/2012 | Gundel | H01B 7/0838 174/350 |
| 2013/0206451 | A1 * | 8/2013 | Arai | H01B 7/295 174/119 R |

(Continued)

*Primary Examiner* — William H. Mayo, III

(74) *Attorney, Agent, or Firm* — Jonathan L. Tolstedt

(57) ABSTRACT

A flame-retardant flat electrical cable has a magnesium oxide dielectric layer. A plurality of spaced apart substantially parallel electrical conductors generally lie in the same plane and extend along the length of the cable. A dielectric layer is disposed on the top and/or bottom sides of the cable and covers the conductors. The dielectric layer has at least 90% magnesium oxide by weight.

20 Claims, 2 Drawing Sheets

(56) References Cited

U.S. PATENT DOCUMENTS

| | | | | |
|---|---|---|---|---|
| 2013/0233590 | A1* | 9/2013 | Shanai | C09J 7/30<br>174/117 F |
| 2014/0090883 | A1* | 4/2014 | Gundel | H01B 7/0838<br>174/350 |
| 2014/0158398 | A1* | 6/2014 | Shanai | H01B 3/421<br>174/117 F |

* cited by examiner

FLAME-RETARDANT FLAT ELECTRICAL CABLE

TECHNICAL FIELD

This disclosure relates generally to electrical cables, and more specifically to flame-retardant flat electrical cables.

BACKGROUND

Many electrical products and devices are not flame-retardant because most of their components are flammable. It can be difficult to design components that are flame-retardant while maintaining the required electrical properties. Halogen is a common ingredient in flame-retardant materials. However, certain industry standards or other specifications may require halogen-free materials. Many other materials which are flame-retardant also reduce the dielectric properties of the insulating materials within the cable, making it difficult to find suitable materials for the dielectric layer(s) in the cable.

SUMMARY

High-speed cables may require a dielectric constant, $D_k$, to be stable at less than 2.35 for all frequencies. The loss tangent, $D_f$, may need to be less than 0.0005 up to 10 GHz and less than 0.0010 at 10-20 GHz. It can be difficult to achieve such $D_k$ and $D_f$ properties, while at the same time meeting the flame-retardance and halogen-free requirements.

The present invention addresses this problem with the use of magnesium oxide as a dielectric material.

The present invention includes a flat electrical cable extending longitudinally along a length z of the cable. A plurality of spaced apart substantially parallel electrical conductors generally lie in the same plane and extend along the length of the cable. A first dielectric layer is disposed on the top and/or bottom sides of the cable and covers the conductors. The first dielectric layer comprises at least 90% magnesium oxide by weight.

The first dielectric layer may have an average thickness of less than about 10 μm, 5 μm, 1 μm, 500 nm, or 300 nm. Alternatively, the average thickness may be greater than about 500 nm or within the range from about 500 nm to about 2 μm.

The first dielectric layer may be at least 95%, 98%, or 99% magnesium oxide by weight.

The first dielectric layer may be a vacuum deposited layer, a vapor deposited layer, a chemically vapor deposited (CVD) layer, a plasma enhanced chemically vapor deposited (PECVD) layer, a sputtering deposited layer, a low-pressure chemically vapor deposited (LPCVD) layer, a plasma assisted chemically vapor deposited (PACVD) layer, an atomic layer deposited (ALD) layer, a thermally vapor deposited layer, an electron beam vapor deposited layer, a laser ablated vapor deposited layer, and/or a physically vapor deposited (PVD) layer.

The flat electrical cable may further include a first dielectric support layer disposed on the first dielectric layer. The first dielectric support layer may be disposed between the first dielectric layer and the electrical conductors. Alternatively, the first dielectric layer may be disposed between the first dielectric support layer and the electrical conductors. The first dielectric support layer may comprise one or more of polycarbonate, polyethylene terephthalate, polystyrene, a polyamide, polyimide, polyetherimide, polyethersulfone, polyphenylene sulfide, polysulfone, polymethylpentene, polyoxymethylene, polyethylene naphthalate, polyether ether ketone, acrylonitrile butadiene styrene, polyurethane, polyethylene, polypropylene, polyester, and polybutylene terephthalate. The first dielectric layer may be vacuum deposited on the first dielectric support layer.

The first dielectric layer may have an average thickness h and the first dielectric support layer may have an average thickness d such that h/d is in a range from about 0.005 to about 0.01. The first dielectric support layer may have an average thickness in a range from about 1 to 500 μm, or within a range from about 5 to 150 μm.

The first dielectric layer may be helically wrapped around the conductors, and may also be overlappingly wrapped. The first dielectric layer may be longitudinally wrapped around the plurality of conductors so that the opposing edges of the first dielectric layer overlap to form an overlap seam. The first dielectric layer may be bonded to itself along the overlap seam via an adhesive layer.

The flat electrical cable may further comprise a second dielectric layer. The two dielectric layers are disposed on the respective top and bottom sides of the cable. The two dielectric layers include cover portions and pinched portions arranged such that, in cross-section, the cover portions of the two dielectric layers in combination substantially surround the conductors, and the pinched portions of the two dielectric layers in combination form pinched portions of the cable on each side of the plurality of conductors. Each of the dielectric layers comprises at least 90% magnesium oxide by weight.

The conductors form a plurality of spaced apart conductor sets, with each conductor set comprising two or more of the conductors. The pinched portions of the two dielectric layers in combination form pinched portions of the cable on each side of each conductor set.

The flat electrical cable may further include an electrically conductive first shielding layer substantially co-extensive with the first dielectric layer. The first dielectric layer may be vacuum deposited on the first shielding layer.

At least one of the conductors may be an uninsulated conductor. Also, at least one of the conductors may be an insulated conductor comprising a central conductor surrounded by an insulative layer. The conductors may form a plurality of spaced apart conductor sets, where each conductor set includes one or more of the conductors, and where each conductor set is wrapped in a different electrically conductive shielding layer. Each electrically conductive shielding layer may be disposed on a corresponding dielectric layer.

The flat electrical cable may further comprise first and second non-conductive polymeric layers disposed on opposite sides of the cable. The two polymeric layers may include cover portions and pinched portions arranged such that, in cross-section, the cover portions of the two polymeric layers in combination substantially surround the conductors, and the pinched portions of the two polymeric layers in combination form pinched portions of the cable on each side of the conductors. The flat electrical cable may further include an adhesive layer adhering the two polymeric layers to each other in each pinched portion of the cable.

The present invention also includes a shielded electrical cable. The cable includes a plurality of conductor sets extending along a length (z) of the cable and arranged generally in a plane along a width (y) of the cable, with each conductor set including one or more insulated conductors. First and second multilayer films are disposed on opposite sides of the cable. The first and second multilayer films include cover portions and pinched portions arranged such that, in transverse cross section, the cover portions of the two multilayer films in combination substantially surround the conductor sets, and the pinched portions of the two multilayer films in combination form pinched portions of the cable on each side of the plurality of conductor sets. An adhesive layer bonds the first multilayer film to the second multilayer film in the pinched portions of the cable. Each of the two multilayer films includes an electrically conductive first layer, an electrically insulative polymeric second layer, and a dielectric third layer, with the three layers being substantially co-extensive with one another. The dielectric third layer includes at least 90% magnesium oxide by weight. Each insulated conductor may comprise a central conductor surrounded by a dielectric material.

The present invention also includes an electrical cable including a plurality of spaced apart electrical conductors extending along a length (z) of the cable. A flame-retardant layer substantially surrounds the conductors and comprises a first vacuum deposited dielectric layer comprising at least 95% magnesium oxide by weight with an average thickness in a range from about 300 nm to about 2 μm.

The flame-retardant layer may include first and second flame-retardant layers disposed on opposite sides of the cable. The flame-retardant layer may be helically or longitudinally wrapped around the conductors.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DESCRIPTION OF ILLUSTRATIVE EMBODIMENTS

Figure 1:
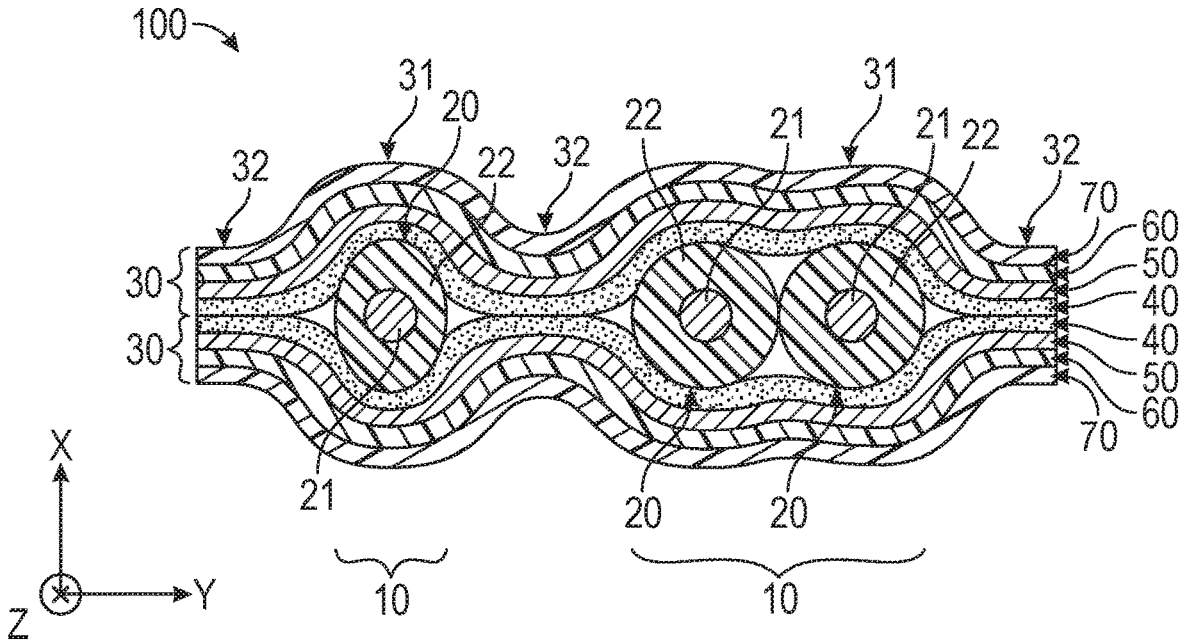
FIGS. 1-3 are schematic cross-sectional views of a flat electrical cable taken perpendicular to the length the cable according to various embodiments of the present invention.

A flat electrical cable 100 according to one embodiment of the present invention is shown in FIG. 1. Cable 100 includes a plurality of conductor sets 10 which may include one or more insulated conductors 20. Insulated conductors 20 include a central conductor 21 surrounded by a dielectric material 22. As shown in FIG. 1, cable 100 extends along the z axis and has a width along the x axis and a height along the y axis.

First and second multilayer films 30 are disposed on opposite sides of cable 100. The first and second multilayer films 30 include cover portions 31 and pinched portions 32 arranged such that, in transverse cross section, the cover portions of the two multilayer films in combination substantially surround conductor sets 10, and the pinched portions of the two multilayer films in combination form pinched portions of cable 100 on each side of the conductor sets. An adhesive layer 40 bonds first multilayer film 30 to second multilayer film 30 in the pinched portions 32 of cable 100. Each of the two multilayer films 30 includes an electrically conductive first layer 50, an electrically insulative polymeric second layer 60, and a dielectric third layer 70, with the three layers being substantially co-extensive with one another.

Dielectric layer 70 may be at least 50%, 70%, 80%, 90%, 95%, 98%, or 99% magnesium oxide (MgO) by weight. Dielectric layer 70 may have an average thickness of less than about 10 μm, 5 μm, 3 μm, 1 μm, 500 nm, 400 nm, 300 nm, or 200 nm. The average thickness may preferably be greater than 100 nm. Alternatively, the average thickness may be greater than about 500 nm or within the range from about 500 nm to about 1 or 2 μm.

Dielectric layer 70 may be a vacuum deposited layer, a vapor deposited layer, a chemically vapor deposited (CVD) layer, a plasma enhanced chemically vapor deposited (PECVD) layer, a sputtering deposited layer, a low-pressure chemically vapor deposited (LPCVD) layer, a plasma assisted chemically vapor deposited (PACVD) layer, an atomic layer deposited (ALD) layer, a thermally vapor deposited layer, an electron beam vapor deposited layer, a laser ablated vapor deposited layer, and/or a physically vapor deposited (PVD) layer.

Figure 2:
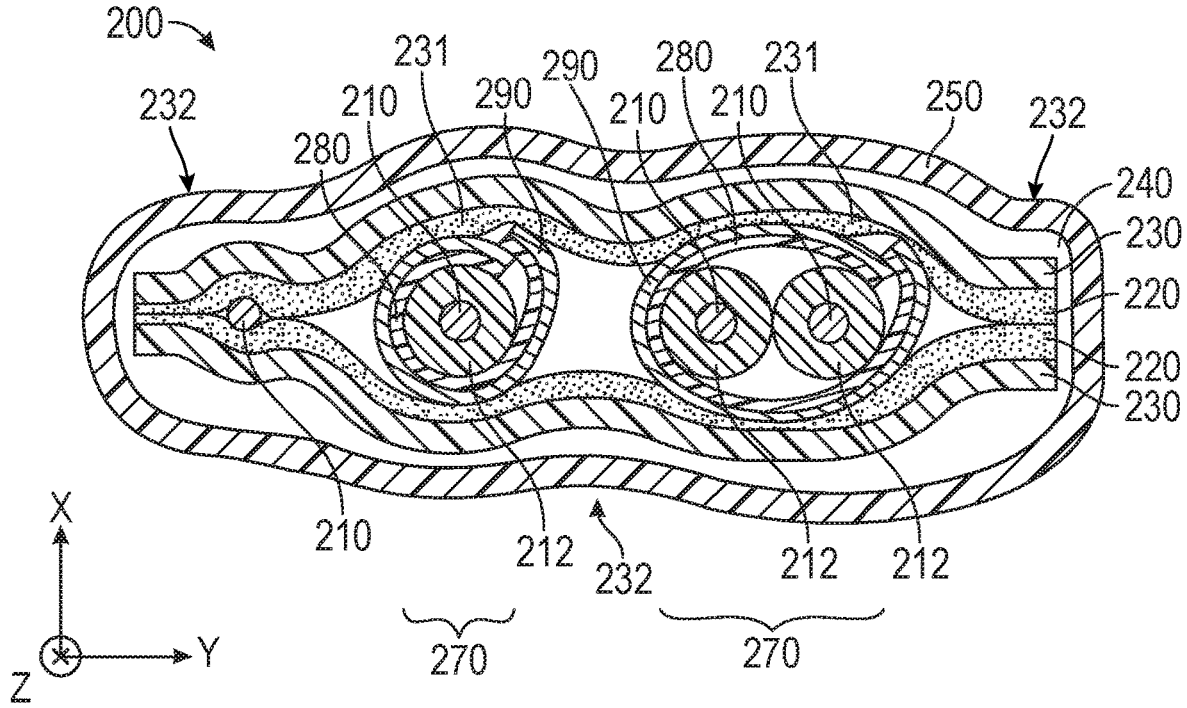

A flat electrical cable 200 according to another embodiment of the present invention is shown in FIG. 2. Cable 200 has a length that extends longitudinally along the z axis and has a width along the x axis and a height along the y axis. Cable 200 includes a plurality of spaced apart substantially parallel electrical conductors sets 270 which generally lie in the same yz plane and extend along the length z of the cable. Conductor sets 270 may include one or more electrical conductors 210 which may be surrounded by a dielectric material 212. Conductors 210 which are not surrounded by a dielectric material may serve as a ground or drain wire.

Each conductor set 270 is wrapped in a different electrically conductive shielding layer 290. Each shielding layer 290 may be disposed on a corresponding dielectric layer 280.

A dielectric layer 250 is disposed on the top and/or bottom sides of cable 200 and covers conductors 210. Dielectric layer 250 may have the same composition, thickness, and other characteristics described above with respect to dielectric layer 70 with respect to FIG. 1.

Cable 200 may further include two non-conductive, shielding polymeric layers 230 disposed on opposite sides of the cable. Polymeric layers 230 include cover portions 231 and pinched portions 232 arranged such that, in cross-section, the cover portions of the two polymeric layers in combination substantially surround conductors 210, and the pinched portions of the polymeric layers in combination form pinched portions of the cable on each side of the conductors. Adhesive layers 220 may adhere the two polymeric layers 230 to each other in each pinched portion 232 of cable 200.

Cable 200 may further include a dielectric support layer 240 disposed on dielectric layer 250. As shown in FIG. 2, dielectric support layer 240 may be disposed between dielectric layer 250 and conductors 210. Alternatively (not shown), dielectric layer 250 may be disposed between dielectric support layer 240 and conductors 210. Dielectric support layer 240 may comprise one or more of polycarbonate, polyethylene terephthalate, polystyrene, a polyamide, polyimide, polyetherimide, polyethersulfone, polyphenylene sulfide, polysulfone, polymethylpentene, polyoxymethylene, polyethylene naphthalate, polyether ether ketone, acrylonitrile butadiene styrene, polyurethane, polyethylene, polypropylene, polyester, and polybutylene terephthalate. Dielectric layer 250 may be vacuum deposited on dielectric support layer 240 or deposited by other known methods.

Dielectric layer 250 may have an average thickness h and dielectric support layer 240 may have an average thickness d such that h/d is in a range from about 0.005 to about 0.01. Dielectric support layer 240 may have an average thickness in a range from about 1 to 500 μm, or within a range from about 5 to 150 μm.

Figure 3:
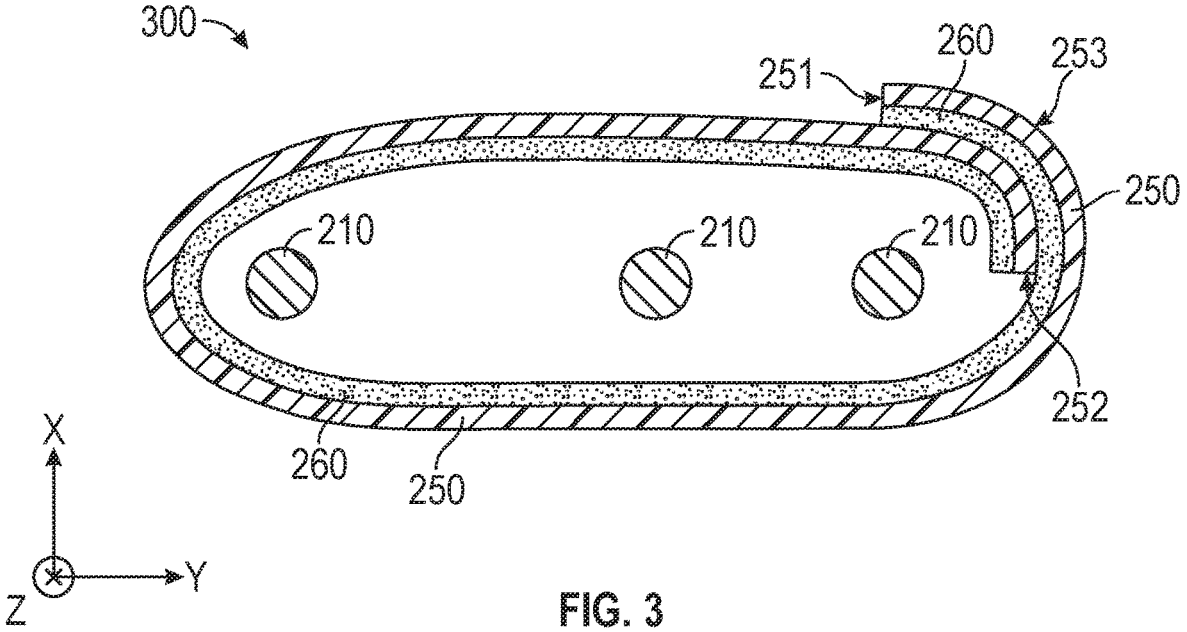

A flat electrical cable 300 according to another embodiment of the present invention is shown in FIG. 3. Cable 300 has a plurality of spaced apart conductors 210. Dielectric layer 250 may be helically wrapped around conductors 210, and may also be overlappingly wrapped. Dielectric layer 250 may be longitudinally wrapped around conductors 210 so that the opposing edges 251 and 252 of the dielectric layer overlap to form an overlap seam 253. Dielectric layer 250 may be bonded to itself along overlap seam 253 with an adhesive layer 260. Dielectric layer 250 may have the same composition, thickness, and other characteristics described above with respect to dielectric layer 70 of FIG. 1.

The present invention may also have application to flexible ribbon cables, shielded/jacketed cables, tapes, and printed circuit boards (PCB) where good dielectric properties and flame-retardance is desired. The dielectric layer comprising magnesium oxide described herein may serve as a flame-retardant layer, which may be helically or longitudinally wrapped around the conductor sets.

Those skilled in the art will appreciate that the appropriate thickness of dielectric layer 70 will depend on a number of factors. For example, where flexibility of the layer is important, a thinner layer is preferred. If the material being protected by dielectric layer 70 is thick, then a thicker dielectric layer may be needed. If the material being protected by dielectric layer 70 has a relatively high combustibility, meaning a limiting oxygen index (LOI)<21%, then a thicker dielectric layer may be needed.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that may vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of this invention will be apparent to those skilled in the art and it should be understood that this scope of this disclosure is not limited to the illustrative embodiments set forth herein. For example, the reader should assume that features of one disclosed embodiment may also be applied to all other disclosed embodiments unless otherwise indicated.

The invention claimed is:

1. A flat electrical cable extending longitudinally along a length of the cable, comprising:

a plurality of spaced apart substantially parallel electrical conductors generally lying in a same plane and extending along the length of the cable; and a first dielectric layer disposed on at least one of top and bottom sides of the cable and covering the plurality of conductors;

wherein the first dielectric layer comprises at least 90% magnesium oxide by weight.

2. The flat electrical cable of claim 1, wherein an average thickness of the first dielectric layer is less than about 10 μm.

3. The flat electrical cable of claim 1, wherein the first dielectric layer comprises at least 95% magnesium oxide by weight.

4. The flat electrical cable of claim 1, wherein the first dielectric layer is one or more of a vapor deposited layer, a chemically vapor deposited (CVD) layer, a plasma enhanced chemically vapor deposited (PECVD) layer, a sputtering deposited layer, a low-pressure chemically vapor deposited (LPCVD) layer, a plasma assisted chemically vapor deposited (PACVD) layer, an atomic layer deposited (ALD) layer, a thermally vapor deposited layer, an electron beam vapor deposited layer, a laser ablated vapor deposited layer, and a physically vapor deposited (PVD) layer.

5. The flat electrical cable of claim 1 further comprising a first dielectric support layer disposed between the first dielectric layer and the electrical conductors.

6. The flat electrical cable of claim 5, wherein the first dielectric layer has an average thickness h, the first dielectric support layer has an average thickness d, h/d in a range from about 0.005 to about 0.01.

7. The flat electrical cable of claim 1, wherein the first dielectric layer is helically wrapped around the plurality of conductors.

8. The flat electrical cable of claim 1, wherein the first dielectric layer is helically and overlappingly wrapped around the plurality of electrical conductors.

9. The flat electrical cable of claim 1, wherein the first dielectric layer is longitudinally wrapped around the plurality of conductors so that opposing edges of the first dielectric layer overlap to form an overlap seam.

10. The flat electrical cable of claim 9, wherein the first dielectric layer is bonded to itself along the overlap seam via an adhesive layer.

11. The flat electrical cable of claim 1 further comprising a second dielectric layer, the first and second dielectric layers disposed on the respective top and bottom sides of the cable, the first and second dielectric layers including cover portions and pinched portions arranged such that, in cross-section, the cover portions of the first and second dielectric layers in combination substantially surround the plurality of conductors, and the pinched portions of the first and second dielectric layers in combination form pinched portions of the cable on each side of the plurality of conductors, wherein each of the first and second dielectric layers comprises at least 90% magnesium oxide by weight.

12. The flat electrical cable of claim 11, wherein the plurality of conductors form a plurality of spaced apart conductor sets, each conductor set comprising two or more of the plurality of conductors, wherein the pinched portions of the first and second dielectric layers in combination form pinched portions of the cable on each side of each conductor set.

13. The flat electrical cable of claim 1 further comprising an electrically conductive first shielding layer substantially co-extensive with the first dielectric layer.

14. The flat electrical cable of claim 1, wherein at least one conductor in the plurality of conductors is an insulated conductor comprising a central conductor surrounded by an insulative layer.

15. The flat electrical cable of claim 1, wherein the plurality of conductors form a plurality of spaced apart conductor sets, each conductor set comprising one or more of the plurality of conductors, wherein each conductor set is wrapped in a different electrically conductive shielding layer.

16. The flat electrical cable of claim 1 further comprising first and second non-conductive polymeric layers disposed on opposite sides of the cable, the first and second polymeric layers including cover portions and pinched portions arranged such that, in cross-section, the cover portions of the first and second polymeric layers in combination substantially surround the plurality of conductors, and the pinched portions of the first and second polymeric layers in combination form pinched portions of the cable on each side of the plurality of conductors.

17. The flat electrical cable of claim 16 further comprising an adhesive layer adhering the first and second polymeric layers to each other in each pinched portion of the cable.

18. A shielded electrical cable, comprising:

a plurality of conductor sets extending along a length of the cable and arranged generally in a plane along a width of the cable, each conductor set comprising one or more insulated conductors;

first and second multilayer films disposed on opposite sides of the cable, the first and second multilayer films including cover portions and pinched portions arranged such that, in transverse cross section, the cover portions of the first and second multilayer films in combination substantially surround the plurality of the conductor sets, and the pinched portions of the first and second multilayer films in combination form pinched portions of the cable on each side of the plurality of conductor sets; and an adhesive layer bonding the first multilayer film to the second multilayer film in the pinched portions of the cable, wherein each of the first and second multilayer films comprises an electrically conductive first layer, an electrically insulative polymeric second layer, and a dielectric third layer, the first, second and third layers being substantially co-extensive with one another;

wherein the dielectric third layer comprises at least 90% magnesium oxide by weight.

19. An electrical cable comprising a plurality of spaced apart electrical conductors extending along a length of the cable, and a flame-retardant layer substantially surrounding the plurality of conductors and comprising a first vacuum deposited dielectric layer comprising at least 95% magnesium oxide by weight and an average thickness in a range from about 300 nm to about 2 μm.

20. The electrical able of claim 19, wherein the flame-retardant layer comprises first and second flame-retardant layers disposed on opposite sides of the cable.

* * * * *